US009895574B2

(12) United States Patent
Gejdos

(10) Patent No.: US 9,895,574 B2
(45) Date of Patent: Feb. 20, 2018

(54) EXERCISE DEVICE FOR STRENGTHENING OF ABDOMINAL MUSCLES

(71) Applicant: Marian Gejdos, Trencin (SK)

(72) Inventor: Marian Gejdos, Trencin (SK)

( * ) Notice: Subject to any disclaimer, the term of this patent is extended or adjusted under 35 U.S.C. 154(b) by 3 days.

(21) Appl. No.: 14/618,353

(22) Filed: Feb. 10, 2015

(65) Prior Publication Data

US 2015/0224360 A1 Aug. 13, 2015

(30) Foreign Application Priority Data

Feb. 12, 2014 (SK) ..... PP 50016-2014

(51) Int. Cl.

| | |
|---|---|
| ***A63B 26/00*** | (2006.01) |
| ***A63B 23/02*** | (2006.01) |
| ***A63B 21/008*** | (2006.01) |
| ***A63B 21/068*** | (2006.01) |
| ***A63B 22/00*** | (2006.01) |
| ***A63B 21/00*** | (2006.01) |
| *A63B 21/002* | (2006.01) |

(52) U.S. Cl.

CPC ..... *A63B 23/0211* (2013.01); *A63B 21/0083* (2013.01); *A63B 21/068* (2013.01); *A63B 21/4035* (2015.10); *A63B 21/4047* (2015.10); *A63B 22/0076* (2013.01); *A63B 21/002* (2013.01); *A63B 22/0087* (2013.01); *A63B 2022/0084* (2013.01); *A63B 2208/0238* (2013.01); *A63B 2208/0247* (2013.01)

(58) Field of Classification Search

CPC ..... A63B 21/00; A63B 21/40; A63B 21/4035; A63B 21/4047; A63B 21/4033; A63B 21/4027; A63B 21/0083; A63B 21/06; A63B 21/068; A63B 21/02; A63B 21/026; A63B 21/023; A63B 23/00; A63B 23/02; A63B 23/0211; A63B 23/0205; A63B 22/0076; A63B 2022/0082; A63B 2022/0084

USPC ..... 482/92, 121–130, 139, 140, 142

See application file for complete search history.

(56) References Cited

U.S. PATENT DOCUMENTS 4,647,041 A * 3/1987 Whiteley ..... A63B 21/015 482/113
4,786,051 A * 11/1988 Mullican ..... A63B 21/0083 188/282.1
4,848,739 A * 7/1989 Schaub ..... A63B 21/00072 482/113
4,911,436 A * 3/1990 Lighter ..... A63B 21/0087 482/113
5,125,884 A * 6/1992 Weber ..... A63B 21/4029 482/142
5,419,750 A * 5/1995 Steinmetz ..... A63B 23/0211 482/111

(Continued)

*Primary Examiner* — Stephen R Crow
*Assistant Examiner* — Garrett Atkinson
(74) *Attorney, Agent, or Firm* — Ostrolenk Faber LLP

(57) ABSTRACT

An exercising device for strengthening of abdominal muscles with a frame having a resistance mechanism, the device including an inclined bench (3) associated with the press arm (4) connected to the resistance mechanism (9) creating resistance force only in one direction, whereas the press arm (4) is pivotally mounted at one end and its other end is positioned above the inclined bench (3), and is provided with means (8) for pushing and/or holding by user's hands.

12 Claims, 6 Drawing Sheets

(56) References Cited

U.S. PATENT DOCUMENTS

| | | | | |
|---|---|---|---|---|
| 5,618,250 | A * | 4/1997 | Butz | A63B 21/0615 482/134 |
| 5,746,688 | A * | 5/1998 | Prager | A63B 23/03533 482/130 |
| 6,500,099 | B1 * | 12/2002 | Eschenbach | A63B 21/062 482/121 |
| 7,172,541 | B2 | 2/2007 | Boland et al. | |
| 7,481,752 | B2 * | 1/2009 | Garner | A63B 21/0083 482/112 |
| 7,635,323 | B2 * | 12/2009 | Halbridge | A63B 21/026 482/121 |
| 2002/0037793 | A1 * | 3/2002 | Eschenbach | A63B 21/062 482/140 |
| 2002/0098957 | A1 * | 7/2002 | Webber | A63B 21/4035 482/138 |
| 2003/0060347 | A1 | 3/2003 | Tang | |
| 2005/0277526 | A1 * | 12/2005 | Bonnell | A63B 21/4005 482/123 |
| 2007/0149371 | A1 | 6/2007 | Gejdos | |
| 2011/0092343 | A1 * | 4/2011 | Habing | A63B 23/1254 482/94 |

* cited by examiner

EXERCISE DEVICE FOR STRENGTHENING OF ABDOMINAL MUSCLES

FIELD OF THE INVENTION

The present invention relates to an exercise device for strengthening of abdominal muscles, especially an exercise device comprising a resistance mechanism composed of a hydraulic system with adjustable resistance.

BACKGROUND OF THE INVENTION

Strong abdominal muscles play an important role in many health aspects, including also back pain, which is frequently caused by an imbalance between the strength of the back and abdominal muscles, up to supporting the correct position of internal organs.

Exercises for strengthening of the abdominal muscles range from sit-ups and crunches, which require almost no exercising device, up to use of devices—exercise devices, which exercise abdominal muscles in a seated or in a supine position.

These exercise devices for strengthening of the abdominal muscles apply the exercise principle of sit-ups and crunches, while providing a possibility of creating a load during the exercise.

Such devices are disclosed e.g. in U.S. Pat. No. 5,419,750; US 2003/0060347 A1; U.S. Pat. No. 7,481,752 B2 and U.S. Pat. No. 7,172,541 B2.

Document U.S. Pat. No. 5,419,750 discloses a device for exercising of mainly the abdominal part of the body, and strengthening of the abdominal muscles, where a repeated sit-up movement is performed against the power of a hydraulic piston. The device comprises a frame with a central longitudinal part provided with legs at its ends, and a bench for the user is placed on this central part, substantially horizontally, actually with a slight declination. The declination of the bench causes the head of the user to be lower than his lower body part when lying on the bench. An extension member is attached perpendicularly to the central longitudinal part, on which an arm is pivotally connected. One end of the arm is bent over the bench and the other end is mounted to the hydraulic piston. Supports for the exerciser's legs are attached to the legs of the frame. The exerciser, when exercising on this device, is seated at the center of the bench near the perpendicular extension member, puts his legs under the leg supports and the end of the arm bent over the bench is held at his chest. The exerciser then performs sit-up exercise against the power of the hydraulic piston mounted at the other end of the pivotally connected arm.

Document US 2003/0060347 A1 discloses a device for strengthening of the abdominal muscles, which comprises a base frame composed of two, for the purpose of length adjustment, opposing moving frames. A footplate for a user's legs is mounted on the second frame of the base frame, and a seat for the user and a pivoted back support are mounted on the first frame of the base frame. The back support has a lower part mounted on a supporting frame, which is pivoted to the first base frame and an upper part of the back support is pivoted to a lower part of the back support. Two handlebars extend from the frame of the upper back support at the upper side, which the user holds by his hands. Between the supporting frame of the back support and the first part of the base frame a damping device in the form of a hydraulic or pneumatic cylinder is provided. The user, when exercising on this device, is seated on the seat, puts his legs against the footplate, leans his back against the back support and holds the handlebars at the upper part of the back support. With this device, the user performs a sit-up exercise, while the damping device in one instance creates resistance against muscle strength, thus strengthening the abdominal muscles, and further dampens the speed of the movement of the back support, whereby no sudden pressure is developed on the neck of the user and therefore this device is safe for use.

Document U.S. Pat. No. 7,481,752 B2 discloses a device for strengthening of abdominal muscles, which is composed of a frame on which the user is seated, the frame has a support arm tilted backward from vertical, with the lower lumbar region of the user against a seat member. The upper part of the seat member assembly is pivotally attached to the frame. The upper part of the seat assembly has a pair of handles and a pad designed to lay against the upper back of the user. The seat back assembly moves with the upper back of the user, and the hands of the user assist in maintaining the upper seat back member against the upper back, while the user moves from a tilted back position to a crunch position, and simulating a traditional sit-up movement. A hydraulic or pneumatic member is attached between the upper part of the seat back assembly and the base of the device, which creates a resistance force when the upper back rest assembly moves with the movement of the user. The hydraulic or pneumatic member is placed so as to provide the smallest resistance force at the beginning of the exercise, i.e. when the torso is lifted, and to increase the resistance force while the torso is moved to an upright position, when the body force needed to overcome the weight of the torso decreases.

Document U.S. Pat. No. 7,172,541 B2 discloses an abdominal exercise machine, having a floor supported bench and a mast pivotally connected to an end of the bench. A pair of double acting hydraulic cylinders are pivotally connected between the end of the bench and the mast. A footrest assembly is connected to the mast. A recumbent exerciser exercises abdominal muscles by pushing and pulling the mast against the resistance of the hydraulic cylinders.

Sit-up exercises with anchored feet besides exercising the abdominal muscles also exercises the hip flexors. This exercise increases pressure on the lumbar region. A sit-up exercise with feet freely put on the ground does not allow the use of external resistance, which is necessary for stimulation of muscle fibers while increasing the strength of abdominal muscles. Crunches exercise abdominal muscles isolatedly, but not in the whole range of motion. The mentioned exercises show these disadvantages also when performed on exercise devices, which are basically developed according to movements performed during sit-up exercises and crunches.

The mentioned disadvantages are eliminated by an exercise device for strengthening of the abdominal muscles disclosed in US 2007/0149371 A1 of the same applicant, which comprises a frame to which a press arm is connected rotatively in a vertical plane. To the press arm a resistance mechanism is connected, preferably a hydraulic cylinder, which exerts resistance force only in a direction against downward movement of the press arm. Free end of the arm can move in a range of motion from a user's waist area to the user's ankles. This device strengthens abdominal muscles isolatedly, while the user is standing. However, no undesired stress on the spine occurs, i.e. the press arm is not loaded when it is lifted (upward movement) and thus no extra stress is applied to the spine as it is e.g. when lifting a weight. However, a disadvantage of this device is that a user exercising on the device lacks the feeling of exercising of the abdominal muscles, as occurs with sit-up exercises and crunches. The user thus perceives exercising on this device as insufficient, or without an effect. This device also, as the user is standing, employs weight of the torso to overcome the resistance force, which decreases the effect of the exercise when exercising on this device.

An object of the invention is to provide a device for strengthening of the abdominal muscles, which applies the principle of sit-up exercises and crunches when exercising the abdominal muscles, wherein exercising on such a device does not have the disadvantages of the traditional sit-up exercises and crunches, performed either without or with use of the exercising device, and performed either without or with an additional resistance force.

It is also an object of the invention to provide a device, which removes a pressure developed on the lumbar region when bending the torso during exercising of the abdominal muscles.

An object of the invention is also a device for strengthening of abdominal muscles, which substantively eliminates disadvantages of devices known from prior art.

Another object of the invention is effective use of an isokinetic resistance mechanism in a device for strengthening of abdominal muscles.

SUMMARY OF THE INVENTION

The above mentioned objects are met with the exercise device for strengthening of abdominal muscles, which is characterized in that it comprises inclined bench for supporting of the back of the user, and to this inclined bench at its lower part a press arm is connected, which is at its one end pivotally mounted and its other end is situated above the inclined bench, and is provided with means for pushing and/or holding by user's hands.

The press arm is connected with a resistance mechanism, which exerts a resistance force only when the arm is pushed, what occurs during lifting and bending of the torso from lying supine on the inclined bench to a seated position.

It is advantageous, when the resistance mechanism is isokinetic, or hydraulic, with adjustable resistance.

It is also advantageous, when the inclined bench for supporting the user's back comprises a groove for the spine. This groove can be in the form of a depression, slot, i.e. the inclined bench is actually divided, or in any other form preventing any pressure from developing directly on the spine when lying on the bench. It is also clear for the person skilled in the art, that regarding the length, the groove can be provided on the entire length of the bench or also only on the part of the length of the bench, supporting the spine, whereas at the place supporting the head, the bench is without the groove.

The device according to this invention applies the principle of sit-up exercise and crunches, while providing the exercises with significant improvements. Firstly, it increases the efficiency of the exercise for strengthening of the abdominal muscles in an isolated manner. This comes from the arrangement comprising an inclined bench above which the press arm is arranged so that the press arm is pushed by the user's extended straight arms. The device, during the lifting phase, when lifting and bending the torso from the inclined bench with simultaneous pushing of the press arm by the hands of the user and pushing the lower part of the torso against the inclined bench, allows exercise of the abdominal muscles, i.e. by flexing and bending of the abdominal part, and prevents exercise only by lifting of the straightened torso around the hips. The groove on the inclined bench allows bending of the torso without any undesired pressure to be developed on the spine from the bench. Using the resistance mechanism acting in one direction, the abdominal muscles effectively strengthen when lifting the torso from a lying to seated position, while during backward movement the abdominal muscles of the lower back part do not need to act against any force except the weight of the torso, but just until the torso is laid on the inclined bench, thus significantly reducing the load on the lower back part.

Due to the arrangement of the device having the inclined bench and preferably with the groove for the spine, the device according to the invention is also suitable for physically weak and elderly users, because the user lifts the torso from the inclined bench and not from a horizontal position or declined position. Lifting of the torso from a horizontal position or a declined position can be a substantial obstacle for physically weak and elderly users to effectively exercise and strengthen of the abdominal muscles.

It is advantageous, if the means for pushing and/or holding by user's hands are positioned on the press arm so, that when the user pushes the arm with his extended straight arms, during bending of the torso, his arms move upwards above his head. In this case the possibility of bending the arms in the elbow joint during the exercise is limited. Thus, the possibility of increasing of the force applied upon the arm of the device by extending the bent arms against the arm of the device is limited, i.e. the push force can not be developed by extending the bent arms against the arm of the device, thus values of the force, exerted by the abdominal muscles through extended arms when flexing and bending the torso, can not be biased when the force applied on the press arm is measured.

A frame with raised feet support can be connected to the base frame. The device allows exercising with feet placed on the ground. To entirely prevent the work of muscles of the legs during the exercise, the user can rest his feet against raised feet support. This actually prevents the user from helping himself by pushing his feet against the ground, and thus separate exercising of abdominal muscles is improved.

BRIEF DESCRIPTION OF THE DRAWINGS

The arrangement of the exercise device for strengthening of the abdominal muscles according to the invention is shown in the attached drawings, where.

DETAILED DESCRIPTION OF THE PREFERRED EMBODIMENTS AND OPERATION OF THE INVENTION

Figure 1:
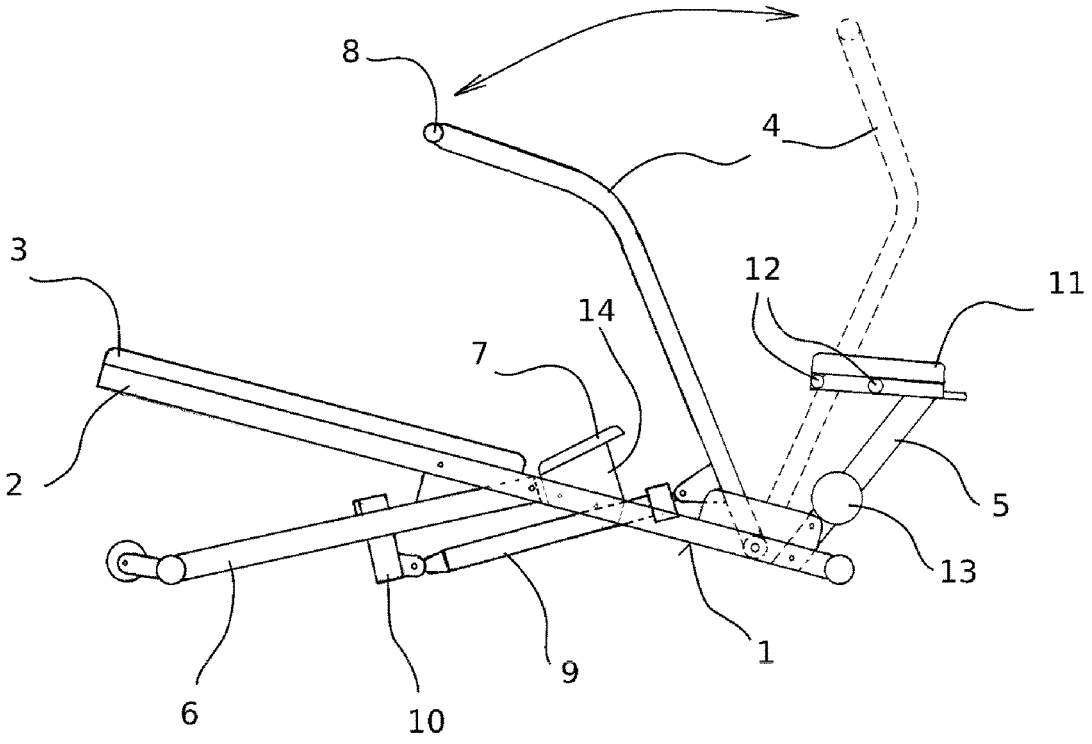
FIG. 1 shows a side view of the device for strengthening of the abdominal muscles according to the invention.
Figure 2:
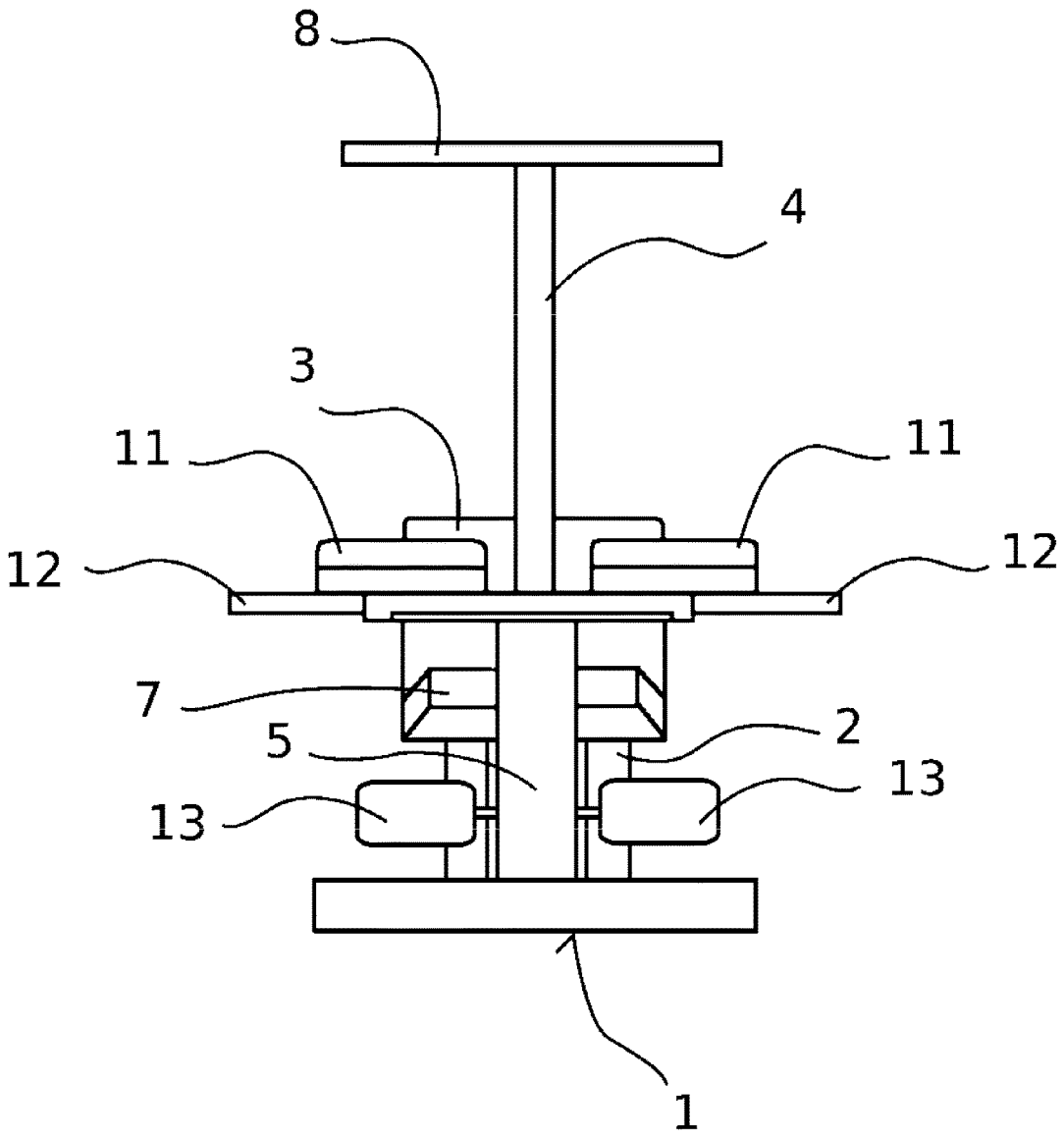
FIG. 2 shows a front view of the device for strengthening of the abdominal muscles according to the invention.

The exercise device for strengthening of abdominal muscles according to FIGS. 1, 2, 3, 4, 5 and 6 comprises a base frame 1, which in this example is composed of two parts. One part is a supporting frame 2 comprising a bench 3, mount of a press arm 4 and a frame 5 of the raised feet support 11, upper feet supporting bars 12, and lower feet holding rolls 13. The second part is a support 6, on which a seat 7 and a connection of a resistance mechanism 9 by means of the holder 10, are positioned. The supporting frame 2 is with its one end placed on the ground and supported by the support 6 in its inclined position. The support 6 is in this example attached to the supporting frame 2 preferably near the lower end of the inclined bench 3. At the lower end of the inclined bench 3 a frame 14 of a seat is connected, onto which the seat 7 is placed. The main function of the seat 7 is to keep the correct position of the user E so that the user E does not slide down the inclined bench 3 during the exercise and at the same time to allow bending of the torso without tilting the torso around the hips. The bench 3 can be provided by a groove 15 for the user's spine.

It is obvious, that the embodiment without the seat 7 is possible, but such an embodiment reduces user's comfort during exercising.

The press arm 4 is pivotally connected to the supporting frame 2. The press arm 4 is made so that its free end is reachable for the user E lying supine on the inclined bench 3. In this example the press arm 4 thus extends over the inclined bench 3 and its free end is provided with a means 8 for pushing and/or holding by hands of the user E. These can be a common handle or a hand rest.

The press arm 4 is connected to a resistance mechanism 9. The resistance mechanism 9 is in this case of the type which develops resistance force in one direction only and preferably is isokinetic. For the invention this is in the direction when the press arm 4 is pushed off the inclined bench 3. The resistance mechanism 9 is in this example connected to the support 6 of the supporting frame 2. It is obvious that the resistance mechanism 9 can be connected to the press arm 4 also in a different manner. However, in this embodiment, regarding the arrangement of the entire device and the elongated shape of the resistance mechanism 9, which in this particular embodiment is a hydraulic cylinder, the most suitable connection is the connection of the resistance mechanism 9 to the lower end of the press arm 4, i.e. near the pivotal mount of the press arm 4 on the supporting frame 2 and to the support 6. In this way, the body of the resistance mechanism 9 is actually placed entirely under the device and thus it does not form an obstacle during exercise.

The drawings show the connection of the body of the resistance mechanism 9 and the support 6 provided through an extended holder 10, but this is not necessary and the resistance mechanism 9 can be connected directly to the support 6.

In this embodiment, the frame 5 of the raised feet support 11, upper feet supporting bars 12, and lower feet holding rolls 13 is attached to the supporting frame 2. The frame 5 of the raised feet support 11, upper feet supporting bars 12, and lower feet holding rolls 13 is not necessary as the exercise, as will be described further, can be performed also without the raised feet support 11, upper feet supporting bars 12, and lower feet holding rolls 13.

Figure 3:
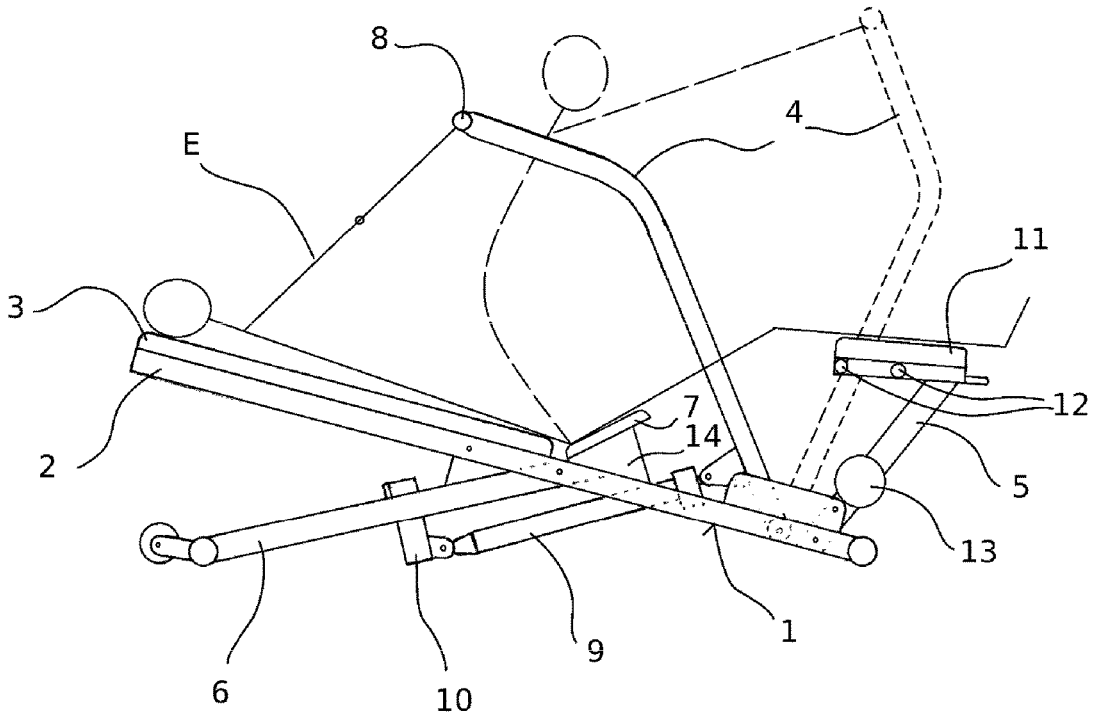
FIG. 3 shows a side view of the device for strengthening of the abdominal muscles according to the invention with a schematically shown user in the positions of sit-up exercises and crunches with his feet rested on a raised feet support.
Figure 4:
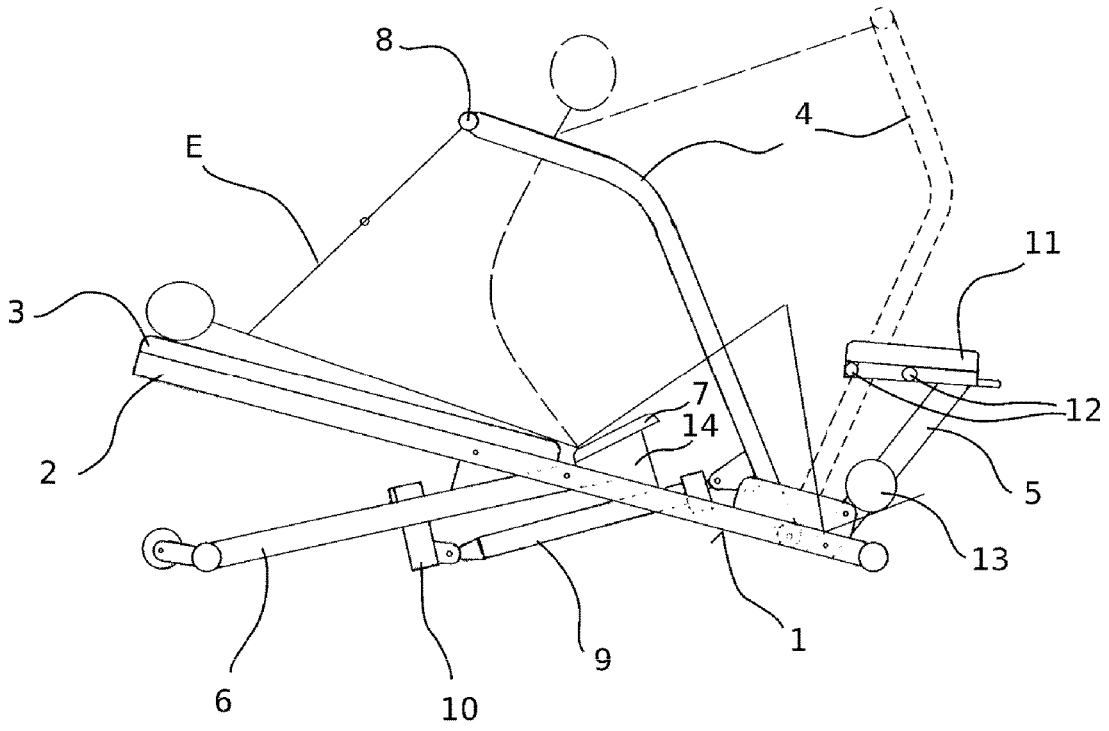
FIG. 4 shows a side view of the device for strengthening of the abdominal muscles according to the invention with a schematically shown user in the positions of sit-up exercises and crunches with his feet hooked under the lower holding rolls.
Figure 5:
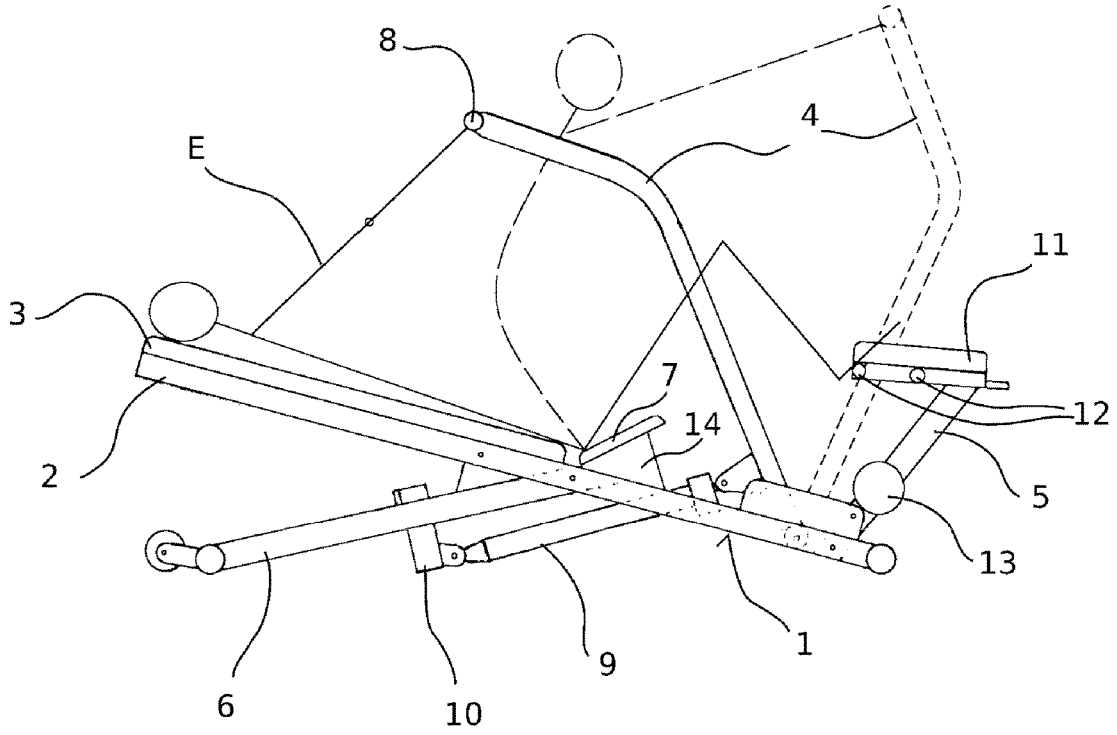
FIG. 5 shows a side view of the device for strengthening of the abdominal muscles according to the invention with a schematically shown user in the positions of sit-up exercises and crunches with his feet pushed against the upper supporting bars.
Figure 6:
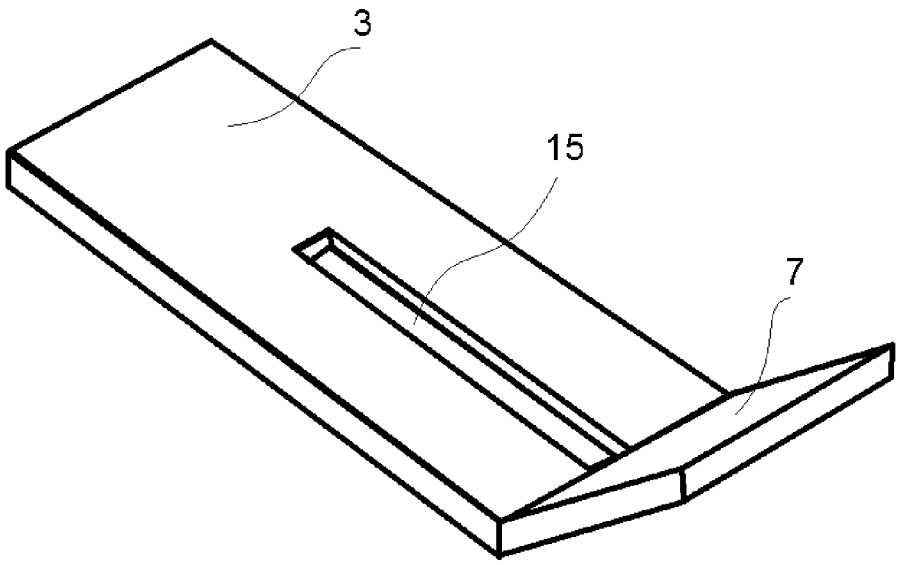
FIG. 6 shows the bench of the device according to the invention with the groove for the user's spine, together with the seat.

With reference to FIGS. 3, 4 and 5, the method of exercise using the exercise device for strengthening of abdominal muscles is the following: The user E is lying supine on the inclined bench 3. Then he grabs the means 8 for pushing and/or holding or rests his hands against them. User E can leave his legs on the ground or he can put his legs on the raised feet support 11, or rest his feet against upper feet supporting bars 12, or he can hook his feet under the feet holding rolls 13. The user E, beginning from the lying supine position on the inclined bench 3, starts bending the torso and lifting the torso to a seated position, while with this movement pushing the press arm 4 with his extended straight arms, where the press arm 4 through connected resistance mechanism 9 exerts a resistance force against the movement of the user E. When an isokinetic mechanism is employed, the faster the user E tries to perform the exercise, the greater is the resistance force on the press arm 4 which must be overcome. After the user E ends movement in the seated position, he then starts to lie back. No resistance force acts on the press arm 4 during this backward movement, and only the weight of the torso itself is applied to the abdominal muscles.

The lower position of the press arm 4 and the user E, i.e. the position at the beginning or the end of the exercise is drawn in a solid line and the upper position of the press arm 4 and the user E, i.e. the upper position in the exercise, is drawn in a dashed line.

The invention claimed is:

1. An exercising device for strengthening of abdominal muscles comprising a frame, a resistance mechanism, an inclined bench for supporting a back of a user in an inclined position, the inclined bench extending at an inclination with respect to a horizontal direction, and a press arm, the press arm being connected to the resistance mechanism, the resistance mechanism creating resistance force in only one direction of movement of the press arm, wherein:

the press arm is pivotally mounted at one end below a lower end of the inclined bench and its other end is positioned above the inclined bench, the one end of the press arm, pivotally mounted below the lower end of the inclined bench, being located closer, in the horizontal direction, to the lower end of the inclined bench than to an upper end of the inclined bench, the press arm is provided with a handle for at least one of pushing and holding by the user's hands, and the other end of the press arm is positioned above the one end of the press arm which is pivotally mounted.

2. The exercising device for strengthening of abdominal muscles according to claim 1, wherein the resistance mechanism is an isokinetic resistance mechanism.

3. The exercising device for strengthening of abdominal muscles according to claim 1, wherein the resistance mechanism is a hydraulic cylinder.

4. The exercising device for strengthening of abdominal muscles according to claim 1, wherein the handle is positioned on the press arm so, that when the press arm is pushed, the user's hands move above the user's head.

5. The exercising device for strengthening of abdominal muscles according to claim 1, further comprising a raised feet support, upper feet supporting bars, and lower feet holding rolls.

6. The exercising device for strengthening of abdominal muscles according to claim 1, wherein the inclined bench comprises a groove for the user's spine.

7. The exercising device for strengthening of abdominal muscles according to claim 1, wherein the frame comprises a supporting frame, the inclined bench is supported by the supporting frame, and the pivotal mounting of the press arm at one end is to the supporting frame, the pivotal mounting of the press arm being located between an upper longitudinal surface of the supporting frame and a lower longitudinal surface of the supporting frame.

8. The exercising device for strengthening of abdominal muscles according to claim 1, wherein the press arm consists of a single lever arm.

9. The exercising device for strengthening of abdominal muscles according to claim 1, wherein the press arm is configured such that when it pivots and the user's hands grasp the handle of the press arm while the press arm is pivoting, the user's hands move in a linear path.

10. The exercising device for strengthening of abdominal muscles according to claim 9, wherein the inclined bench and the press arm are configured such that when the press arm pivots and the user's hands grasp the handle of the press arm while the press arm is pivoting, the torso of the user rotates between a first position where the user is lying supine on the inclined bench and a second position where the torso of the user is at a maximum angular displacement with respect to the inclined bench.

11. The exercising device for strengthening of abdominal muscles according to claim 1, wherein the inclined bench is configured so that an upper part of the inclined bench supports at least an upper part of the user's torso when the user lies on the inclined bench.

12. The exercising device for strengthening of abdominal muscles according to claim 1, wherein the inclined bench is configured so that a lower part of the inclined bench supports a lower part of the user's torso when the user lies on the inclined bench.

* * * * *